United States Patent [19]

Capy

[11] Patent Number: 4,779,753

[45] Date of Patent: Oct. 25, 1988

[54] MULTIFUNCTIONAL CONTAINER

[76] Inventor: Gilbert Capy, La Botte - Jarnioux, 69640 Denice, France

[21] Appl. No.: 22,747

[22] Filed: Mar. 6, 1987

[30] Foreign Application Priority Data

Mar. 6, 1986 [FR] France ..... 8603386

[51] Int. Cl.[4] ..... B65D 1/24; B65D 21/02; A47G 19/00; A45D 33/00

[52] U.S. Cl. ..... 220/23; 220/23.83; 220/252; 220/255; 220/334; 206/823; 312/285; 312/312; 132/295; 132/314

[58] Field of Search ..... 132/79 R, 82 C, 82 D, 132/82 F:83 C, 83 G; 220/331, 252, 255, 23.83, 23.86, 8, 334, 20, 23; 401/17, 60, 91, 117, 59, 160, 159, 164, 167, 272, 273, 274, 275, 279, 288, 292; 206/823; 312/272.5, 285, 312

[56] References Cited

U.S. PATENT DOCUMENTS

| | | | |
|---|---|---|---|
| 280,830 | 7/1883 | Jameson | 222/386.5 |
| 1,626,842 | 5/1927 | Kendall | 132/83 C X |
| 2,405,958 | 8/1946 | Kelley | 401/91 X |
| 2,630,362 | 3/1953 | Bass | 312/285 |
| 2,707,379 | 5/1955 | Guior | 220/331 X |
| 2,941,511 | 6/1960 | Cieremans | 401/117 X |
| 3,229,695 | 1/1966 | Kaufmann | 312/312 X |
| 3,341,884 | 9/1967 | Pryor | 401/17 |
| 3,709,618 | 1/1973 | Gruska | 401/59 X |
| 3,904,035 | 9/1975 | Metzler et al. | 220/331 X |
| 4,557,618 | 12/1985 | Iwata et al. | 401/17 X |
| 4,606,665 | 8/1986 | Schleif et al. | 401/117 X |

FOREIGN PATENT DOCUMENTS

| | | | |
|---|---|---|---|
| 168882 | 7/1934 | Switzerland | 132/83 C |

*Primary Examiner*—Richard J. Apley
*Assistant Examiner*—David J. Bender
*Attorney, Agent, or Firm*—Sandler & Greenblum

[57] ABSTRACT

A container of generally elongated, cylindrical shape. The container has one or more terminal sections, each provided with one or more recesses. The recesses are concealed and exposed by one or more ferrules mounted to slide on the container. Each recess is provided with a tray, which rotates out of the recess in conjunction with exposure of the recess by a ferrule, and rotates into the recess in conjunction with concealment of the recess by a ferrule.

23 Claims, 4 Drawing Sheets

Fig. 3
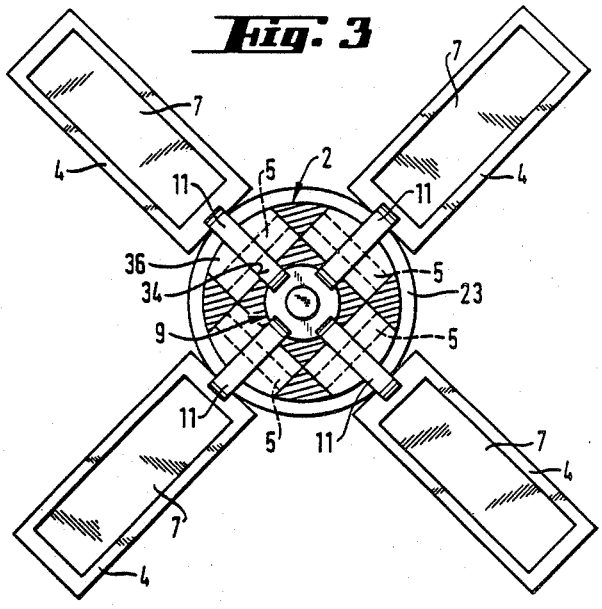
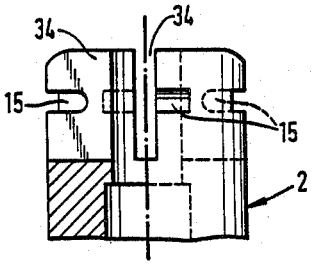
Fig. 4A
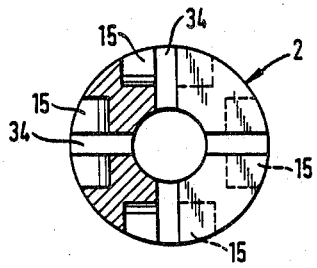
Fig. 4B

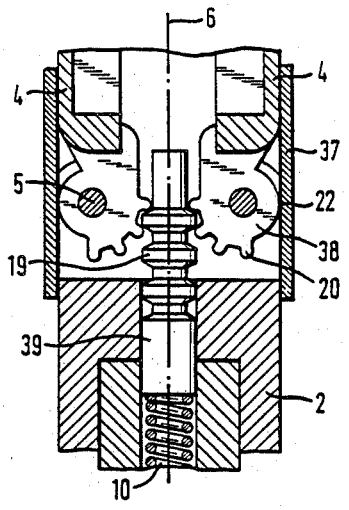
Fig. 5
Fig. 6
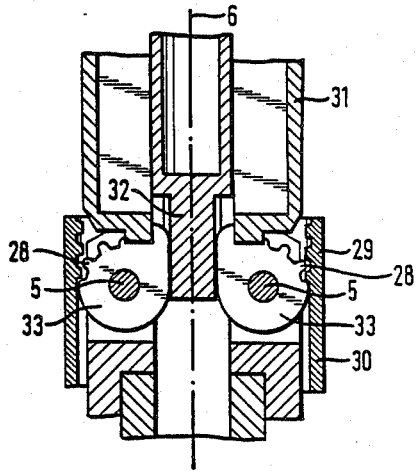

MULTIFUNCTIONAL CONTAINER

BACKGROUND OF THE INVENTION

1. Field of the Invention

This invention relates to a container, more particularly to a make-up compact, and specifically to a make-up compact with multiple compartments.

2. Description of Background and Relevant Materials

It is well-known that cosmetic accessories include, but are not limited to, assorted cosmetics, such as mascaras, powders, and creams, and various implements, such as crayons, brushes, tweezers, pencils, and the like. Customarily, these materials, which are of a variety of shapes, and generally cumbersome, are carried separately.

The application of make-up can be a complicated procedure, and often requires appropriate surroundings. When, while travelling, or in the course of an evening out, a woman desires to touch up her make-up, she does not always have these appropriate surroundings. Accordingly, performing the various functions associated with the application of make-up can be somewhat difficult.

The present invention, intended to overcome the above-indicated problems, is a container, particularly suited for use as a make-up compact. It can be carried outside of a purse, in a pocket, or attached to a chain to be suspended around the neck. Except for the various implements such as pencils, tweezers, crayons, and brushes, the container has no pieces, such as caps or subassemblies, which can come loose. Accordingly, using the container of this invention, one can perform the procedures of applying make-up without requiring a place for laying out the various cosmetics and implements.

Furthermore, access to the various cosmetics and implements mounted in the container of the invention can be gained with a single hand. The container can be grasped in one hand and pressed against a resistant surface, such as the back of the other hand, a wall, or a table, to provide support for manipulating the opening of the various compartments in the container.

The container of the invention has a generally cylindrical shape, and comprises three principle sections—one section at each end for housing the various make-up compositions and accessories, and a central section for receiving the closing elements associated with the indicated terminal sections to provide access to the various accessories.

SUMMARY OF THE INVENTION

One embodiment of the invention is broadly directed to a generally cylindrical and elongated container having least one terminal section. The terminal section has an outer wall and is provided with at least one recess. At least one cover means is mounted for movement along the longitudinal axis of the container to a first position, to expose the at least one recess, and to a second position, to conceal the at least one recess.

Preferably, the cover means comprises a ferrule, and the container further comprises at least one surface for pressing against a resistance to support the axial movement of the ferrule toward the surface, thereby exposing the at least one recess.

The at least one terminal section of the container may further include an axially situated housing having a socket for receiving compositions or implements, preferably cosmetic compositions or implements. Preferably, this housing is adapted to mate with a cap for covering the housing, particularly a cap adapted to hold an implement for inserting in the socket.

The at least one terminal section of the container of the invention may comprise any of a number of structures.

In one embodiment, the terminal section may comprise a receptacle, or an attachment for holding an implement, affixed in each at least one recess.

In another embodiment, the terminal section may include a tray mounted to rotate into and out of the at least one recess. Preferably, this embodiment further includes a cam integral with each such tray, also mounted to rotate within the at least one axis, and an axis supporting the rotation of the cam. Most preferably, this embodiment further comprises not only a plunger means abutting the cam and mounted in the container for movement along the longitudinal axis of the container to rotate the cam, but also a spring mounted in the container to urge the plunger means against the cam, so that axial movement of the cover means to expose the recess permits the tray to rotate out of the recess.

The cam may reside in a housing comprising two parallel walls situated on either side of the cam. The parallel walls of said housing may have a plane of symmetry passing through the longitudinal axis of the container, and an opening, perpendicular to these walls, in which the axis of the cam resides; in this configuration, the cam abuts the cover means and the plunger means, and is thereby stabilized for rotation.

The cam may have a curved exterior and a flange extending therefrom, so that, during the axial movement of the ferrule to the second position, its edge comes into and maintains contact with the flange, thereby controlling the speed of rotation of the tray out of the recess. The length of the ferrule may be calculated so that, in its second position, the flange of the cam rests on the ferrule's edge, thereby resisting the spring and maintaining the tray in the open position.

The cam may have a second flange protruding from its curved exterior. The plunger means may comprise:

(a) a base section abutting the spring;

(b) a first cylinder of rotation integral with the base section and abutting the cam, preferably on its second flange, throughout the rotation of the cam; and (c) a second cylinder of rotation integral with and having a smaller axial diameter than the first cylinder of rotation, abutting the cam when the ferrule is in its first position.

In another embodiment of the terminal section employing the rotatable tray, the cam may have a curved exterior with a plurality of teeth protruding therefrom, and the plunger may comprise a rack engaged with the cam teeth to rotate the cam. Preferably, this embodiment of the terminal section is provided with a plurality of recesses mounted with trays, and rotation of the trays is synchronous.

In a still further embodiment of the terminal section employing the rotatable tray, the cam comprises a curved exterior with a plurality of teeth protruding therefrom, and the ferrule comprises a rack engaged with the cam teeth to rotate the cam. The movement of the ferrule along the longitudinal axis of the container to expose the recess rotates the tray out of the recess;

axial movement of the ferrule in the opposite direction, to conceal the recess, rotates the tray back into the recess. Preferably, this embodiment further comprises a support which abuts the cam and is affixed in the container along its longitudinal axis. Most preferably, this embodiment further comprises a plurality of recesses and trays mounted therein, with synchronous rotational movements of the trays.

In a preferred embodiment, the container of the invention comprises two terminal sections located at the opposite ends of the container. Preferably, each of the terminal sections is provided with its own ferrule. Most preferably, the end of each terminal section serves as the surface for pressing against a resistance to support axial movement of the ferrule associated with the other terminal section. This embodiment further preferably comprises a central section adapted to receive one of the ferrules at a time, thereby providing for successive exposure of the recesses in the respective terminal sections.

All of the previously discussed terminal section structures may be employed with the container of this invention. Where the container is provided with two terminal sections, they may be of the same or different structure; any of the terminal section structures previously discussed may be used, in any configuration.

BRIEF DESCRIPTION OF THE DRAWINGS

FIG. 3 is a cross-sectional view, down through the principal axis of the container, of the top of the terminal section of FIG. 2B, showing the configuration of the trays in their open position;

FIG. 4A is a cutaway cross-sectional view along the principal axis of the container, showing the housings for the cams and their axes;

FIG. 4B is a cross-sectional view of FIG. 4A perpendicular to the principal axis of the container;

FIG. 5 is a cross-sectional view, along the principal axis of the container, of a third embodiment of the terminal section, incorporating a rack which is integral with the plunger means and engages cam teeth to provide for synchronous movement of the trays;

FIG. 6 is a cross-sectional view, along the principal axis of the container, of a fourth embodiment of the terminal section, incorporating a rack which is integral with the ferrule and engages cam teeth to provide for synchronous movement of the trays.

DESCRIPTION OF PREFERRED EMBODIMENTS

Figure 1A:
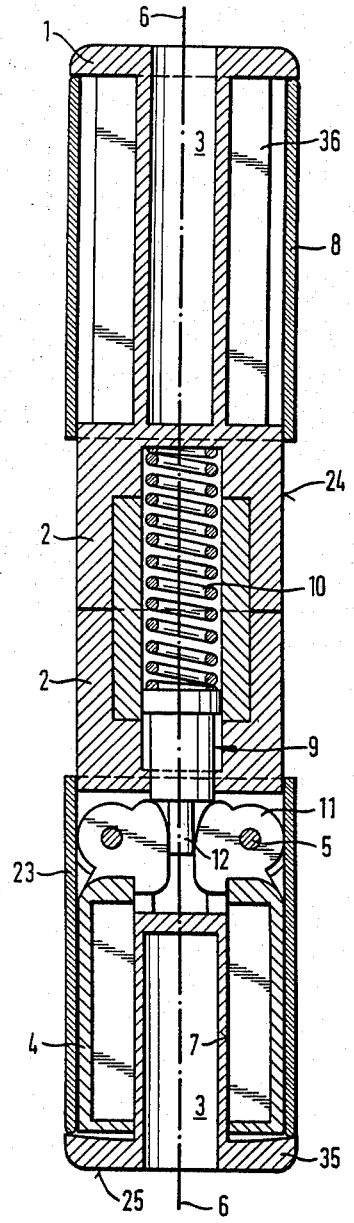
FIG. 1A is a cross-sectional view along the principal axis of one embodiment of the container of the invention, comprising terminal sections of different structure.

FIG. 1A shows end sections 1 and 35 which have different structures, but certain similar elements. Each comprises cylindrical housing 3, which is coaxial with axis 6 of the container, and also has a socket with a depth such that it does not interfere with the operation of the components of central section 2. Positioned laterally in end sections 1 and 35 are recesses 36, covered entirely or in part by ferrule 8 and 23, respectively. The cylindrical socket of housing 3 can terminate in threaded neck portion 40, allowing for attachment of a cap. Any conventional make-up implement, such as a crayon, a pencil, a tweezer, or a brush, such as a mascara brush, can be attached to such a cap for insertion in housing 3. Where the implement is a mascara brush, the mascara paste must first be introduced into the socket of housing 3.

The annular spaces in end sections 1 and 35 not occupied by cylindrical housing 3 are provided with recesses 36, of approximately parallelepipedic shape, which open onto the lateral cylindrical wall of the end section. These recesses can serve to store various make-up accessories, such as compositions and implements, including compressed powders, creams, crayons, tweezers, brushes, pencils, and the like. As shown in FIG. 1A, recesses 36 are closed by means of cylindrical ferrule 8 mounted to slide on the cylinder of the container. Ferrule 8, shown in FIG. 1A as covering recesses 36, is adapted to uncover them by sliding along longitudinal axis 6 onto surface 24 of central section 2, thereby providing for exposure of recesses 36.

Recesses 36 can be provided with a variety of components. Attachments such as clip 41 for retaining accessories and implements such as crayons, tweezers, pencils, brushes, and the like, can be mounted in recesses 36. Alternatively, receptacles such as receptacle 42, for containing make-up compositions and products, can be mounted therein. Ferrule 8 can be retracted to provide direct access to such receptacles; the container can then be turned between the fingers to successively present each such receptacle in front of the user.

Figure 2A:
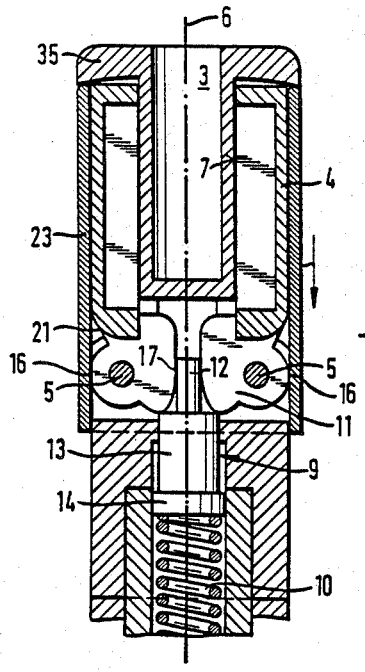
FIG. 2A is a cross-sectional view, along principal axis 6, of one type of terminal section, incorporating rotatable trays, and shows the section in the closed position.
Figure 2B:
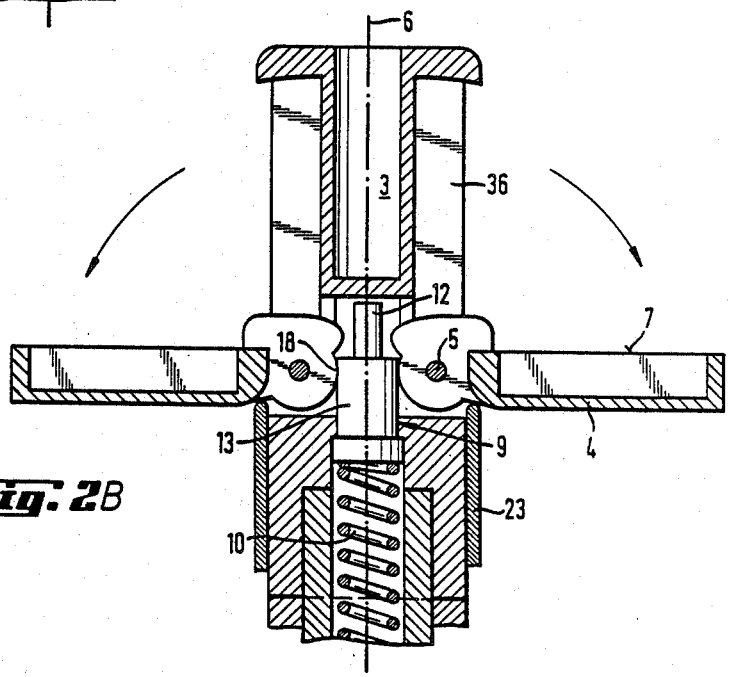
FIG. 2B shows the terminal section of FIG. 2A in the open position.

In a still further embodiment, as shown in FIGS. 2A and 2B, tray 4 is mounted in opening 36 with upward face 7 turned in towards the interior of the container. The base of tray 4 is provided with axis 5, perpendicular to axis 6 of the principal cylinder of the container, around which axis tray 4 pivots. Tray 4 is retained in the closed position by ferrule 23, which covers the whole or a portion of the length of tray 4. Ferrule 23 slides toward central section 2 to free trays 4, which then pivot around their respective axes 5. Trays 4 thereby rotate out of recesses 36 to present their respective upward faces 7, which provides access to the contents of trays 4; such contents may comprise any suitable make-up compositions, accessories, implements or the like.

For aesthetic reasons, it is preferable that all of trays 4 situated in their respective recesses 35 be adapted to open and close simultaneously, as in the manner of the petals of a flower, as shown in FIGS. 2A and 2B, and, more particularly, in FIG. 3. As shown in FIG. 2B, it is preferable that means be provided for maintaining trays 4 in the open position. In an embodiment where trays 4 are adapted for such synchronous movement, they may be alternatively referred to as petals.

In providing for synchronous movement of trays 4, ferrule 23 is of such length as, in the closed position, to cover all or a portion of trays 4, as shown in FIG. 2A. As shown in FIG. 2B, sliding ferrule 23 along the container parallel to principal axis 6 exposes trays 4. Helicoidal spring 10, maintained in a compressed state by the pressure of ferrule 23 against trays 4, expands as ferrule 23 slides toward central section 2 to expose trays 4. Helicoidal spring 10 biases pusher 9, which actuates cam 11, integral with tray 4, to rotate around axis 5, and thereby open tray 4. As tray 4 is opening, ferrule 23 presses on flange 21 of cam 11; thereby, ferrule 23 on the one hand, maintains tray 4 in position against the pressure provided by pusher 9, and, on the other hand, controls the speed at which tray 4 rotates into the open position.

The length of ferrule 23 and its path of axial movement are calculated so that, on the one hand, when ferrule 23 retains petal 4 in the closed position, as shown in FIG. 2A, ferrule 23 completely covers all of the mechanism for actuating tray 4, particularly cam 11. When ferrule 23 is situated at the end of its path of axial movement, with tray 4 residing in the open position, cam 11 rests, preferably by a flange, on an edge of ferrule 23, thereby maintaining tray 4 at the desired angle of inclination; on its other side cam 11 abuts, preferably by a second flange, pusher 9. By these means, tray 4 is maintained in the open position, preferably at the desired angle of inclination.

FIGS. 4A and 4B show housing 34, in which cam 11 resides. Housing 34 is formed of two parallel walls; these walls, having a plane of symmetry which passes through principal axis 6, serve to guide the rotation of cam 11. Two parallel edges in the perpendicular walls of housing 11 form opening 15, which is perpendicular to principal axis 6. Axis 5 resides in opening 15, which acts as a longitudinal guide for its rotation.

The configuration of cam 11 ensures that, during movement of axis 5, to which cam 11 is perpendicular, the cam will be maintained perpendicular to principal axis 6. This stability is provided by ferrule 23 and pusher 9. Pusher 9 comprises cylinders of revolution 12 and 13, and section 14. Section 14, wih section 13, serves to guide the movement of plunger 9 along axis 6. Cam 11 is maintained in position by means of its contact with ferrule 23 at point 16, and with plunger 9 at points 17 and 18 of cylinders of revolution 12 and 13, respectively.

The support provided for cam 11 by ferrule 23 at point 16, and by plunger 9 at points 17 and 18, allow the manufacture of central section 2, as well as the positioning of tray 4, to be simplified. As shown in FIGS. 4A and 4B, axis 5 is engaged in space 15, thereby stabilizing cam 11 in housing 34; in turn, as shown in FIG. 2A, tray 4 is stabilized in recess 36. Consequently, the positioning, first of ferrule 23, and then of plunger 9, maintains the entire assembly in position.

Mounting rotatable tray 4, fixed clip 41, or fixed receptacle 42, the latter being positioned to face away from longitudinal axis 6, are all contemplated within the scope of the invention. However, the use of rotatable tray 4 provides an advantage over such fixed elements. As shown in FIG. 1A, for the terminal section wherein fixed elements are employed, ferrule 8 must serve as a cover for such receptacles, and therefore must entirely cover recess 36. However, where rotatable trays are employed, the ferrule is not required to serve as a cover, and therefore can be much shorter than the trays it maintains in position.

As shown in FIG. 2B, when ferrule 23 is situated at the end of its path of axial movement and trays 4 reside in the open position, pivoting a single tray 4 back into the closed position presses plunger 9 back into central section 2, thereby freeing the remaining trays 4 to rotate freely around their respective axes 5. As shown in FIG. 5, it can be advantageous to synchronize the movement of trays 4 by replacing cylinders of rotation 12 and 13 of plunger 9 with rack 19, which engages toothed portion 20 of cam 38. Plunger 39, and, more particularly, rack 19, serve as abutments to maintain cam 38 in position. Furthermore, ferrule 37 wedges cam 38 in position a point 22, thereby maintaining axis 5 in its seat. Under these conditions, manually moving tray 4 from the open to the closed position imparts the same movement to the other trays.

FIG. 6 shows an embodiment of the container of the invention wherein the opening of the trays is synchronized instead by ferrule 30. During the initial stage of the opening of trays 31, rack portion 29 of ferrule 30 engages toothed sector 28 situated on the exterior of cam 33, thereby exerting a mechanical pressure which compels the trays to open. To ensure that the opening rotation of the trays is not disturbed, the number of teeth provided in rack 29 is not greater than the number of spaces provided between the teeth of toothed portion 28 of cam 33.

In the embodiment shown in FIG. 6, plunger 9 and spring 10 are not required. However, fixed support 32, having a profile adapted to cam 33, is necessary. Because rack 29 is situated in the vicinity of tray 4, it is possible, by modifying the position of the teeth of the rack, to provide different opening angles for the trays, and to maintain the trays in the desired position for a single displacement of ferrule 30.

The container of the invention may be provided with two terminal sections having the same or differing structures, employing terminal sections having the structures of any of those shown in FIGS. 1A–6, in any combination. Specifically, the container may be provided with two terminal sections each having fixed receptacles, fixed clips, or a combination thereof, mounted in the recesses, or one terminal section employing such fixed elements, and the other employing rotatable trays, as shown in FIG. 1A. Conversely, the container may employ two terminal sections both having rotatable trays mounted in the recesses of the respective sections, as shown in FIG. 1B. Terminal sections having the structures shown in FIGS. 5 and 6 may be substituted for any or all of the terminal sections employed in the embodiments previously discussed.

Figure 1B:
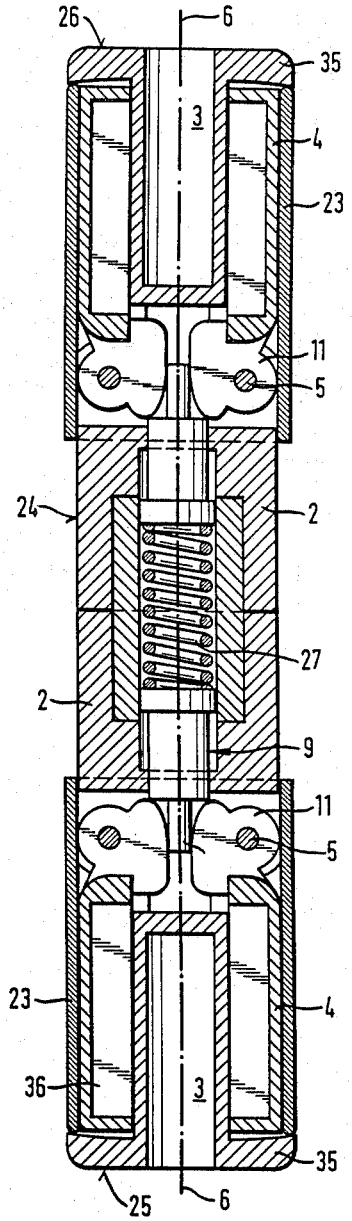
FIG. 1B is a cross-sectional view along the principal axis of a second embodiment of the container of the invention, having terminal sections of the same structure.

The opening angle of the rotatable trays can be varied according to the length of the ferrule associated with the terminal section housing such trays. Where both terminal sections of the container house rotatable trays, as shown in FIG. 1B, a single spring, such as spring 27 shown in this Figure, may be used to actuate the trays residing in both terminal sections 35. The rotatable trays of one such terminal section may be rotated into the open position by grasping the ferrule associated with that terminal section between the two fingers of one hand, and pressing the end surface of the other terminal section against a resistant surface. To rotate these trays back into the closed position, the ferrule associated with the terminal section housing the trays is grasped, and the end surface of the same terminal section is pressed against a resistant surface, such as the back of the other hand, whbich may be grasping a brush.

There is no difficulty attendant in using two hands to unscrew a cap—such as a cap carrying an implement, like a mascara brush, residing in the cylindrical housing socket of the terminal section—provided that the other make-up operations have been completed.

Although the terminal sections shown in the drawings are all provided with four recesses, the recesses may be of any number as required, and may be positioned symmetrically or unsymmetrically.

Although the container of the invention is discussed primarily with regard to its utility as a make-up compact, it is to be understood that the container may be used for any other suitable purpose, such as to store any and all sorts of compositions, substances, implements, accessories, and articles, including, but not limited to, candies, pills, lozenges, hairpins, pharmaceuticals, and the like.

It is further understood that although the invention has been specifically described with reference to particular means and embodiments, the foregoing description is that of preferred embodiments of the invention, and the invention is not limited to the particulars disclosed, but extends to all equivalents, and various changes and modifications may be made in the invention without departing from the spirit and scope thereof.

What is claimed is:

1. A container of generally elongated cylindrical shape comprising:

(a) at least one terminal section with an outer wall having at least one recess therein;

(b) at least one ferrule mounted for movement along the longitudinal axis of said container to a first position to expose said at least one recess, and to a second position to conceal said at least one recess;

(c) a tray mounted to rotate into and out of each said at least one recess; and (d) at least one surface for pressing against a resistance to support axial movement of said ferrule toward said surface and thereby expose said at least one recess.

2. The container as defined by claim 1 wherein said at least one terminal section comprises a housing, situated on the axis of said container, having a socket for receiving a composition or implement.

3. The container as defined by claim 2 wherein said housing is adapted to mate with a cap for covering said housing.

4. The container as defined by claim 1 wherein:

(a) said at least one terminal section comprises two terminal sections situated at opposite ends of said container;

(b) said at least one ferrule comprises two ferrules, one associated with each terminal section; and (c) said at least one surface comprises two surfaces, one situated at the end of each terminal section.

5. The container as defined by claim 4 further comprising a central section adapted to receive said ferrules one at a time, for successive exposure of said at least one recess in said outer wall of each said respective terminal section.

6. The container as defined by claim 1 wherein said at least one terminal section further comprises a receptacle affixed in said at least one recess.

7. The container as defined by claim 6 wherein:

(a) said at least one terminal section comprises two terminal sections situated at opposite ends of said container;

(b) said at least one ferrule comprises two ferrules, one associated with each terminal section; and (c) said at least one surface comprises two surfaces, one situated at the end of each terminal section.

8. The container as defined by claim 7 further comprising a central section adapted to receive said ferrules one at a time, for successive exposure of said at least one recess in said outer walls of said respective terminal sections.

9. The container as defined by claim 1 wherein said at least one terminal section further comprises an attachment, for holding an implement, affixed in said at least one recess.

10. The container as defined by claim 1 wherein said at least one terminal section further comprises, for each tray:

(a) a cam integral with said tray, mounted to rotate within said at least one recess; and (b) an axis supporting the rotation of said cam.

11. The container as defined by claim 10 wherein said at least one terminal section comprises a plunger means, abutting said cam, mounted for movement along said longitudinal axis of said container to rotate said cam, and wherein said container further comprises a spring mounted in said container to urge said plunger means against said cam; whereby axial movement of said ferrule to expose said at least one recess permits said tray to rotate out of said at least one recess.

12. The container as defined by claim 11 further comprising, for said cam, a housing comprising two parallel walls, one situated on either side of said cam, said walls having:

(a) a plane of symmetry passing through said longitudinal axis of said container; and (b) an opening perpendicular to said walls for maintaining said axis of said cam; and wherein said cam abuts said ferrule and said plunger, whereby said cam is stabilized for rotation.

13. The container as defined by claim 11 wherein:

(a) said at least one terminal section comprises two terminal sections situated at opposite ends of said container;

(b) said at least one ferrule comprises two ferrules, one associated with each terminal section; and (c) said at least one surface comprises two surfaces, one situated at the end of each terminal section; and wherein said spring is positioned to urge said plunger means of both terminal sections against their respective cams.

14. The container as defined by claim 13 further comprising a central section adapted to receive said ferrules one at a time, for successive exposure of said at least one recess in said outer walls of said respective terminal sections.

15. The container as defined by claim 11 wherein:

(a) said cam comprises a curved exterior and a first flange protruding from said curved exterior, whereby an edge of said ferrule, during the axial movement of said ferrule to said second position, comes into and maintains contact with said flange, thereby controlling the speed of rotation of said tray out of said at least one recess; and (b) the length of said ferrule is calculated so that, when said ferrule is in said second position, said first flange rests on said edge of said ferrule to resist said spring and to maintain said tray in an open position.

16. The container as defined by claim 15 wherein:

(a) said cam comprises a second flange protruding from said curved exterior; and (b) said plunger means comprises:

(i) a base abutting said spring;

(ii) a first cylinder of rotation integral with said base and abutting said second flange throughout its rotation; and (iii) a second cylinder of rotation integral with said first cylinder of rotation, having a smaller axial diameter than said first cylinder of rotation, and abutting said cam when said ferrule is in said first position.

17. The container as defined by claim 15 wherein:

(a) said cam comprises a curved exterior and a plurality of teeth protruding from said curved exterior; and (b) said plunger comprises a rack engaged with said teeth to rotate said cam.

18. The container as defined by claim 17 wherein said at least one recess comprises a plurality of recesses, whereby rotation of said trays is synchronous.

19. The container as defined by claim 10 wherein:

(a) said cam comprises a curved exterior and a plurality of teeth protruding from said curved exterior; and (b) said ferrule comprises a rack engaged with said teeth to rotate said cam; so that movement of said ferrule along the longitudinal axis of said container to expose said at least one recess rotates said tray out of said at least one recess, and movement of said ferrule along the longitudinal axis of said container to conceal said at least one recess rotates said tray into said at least one recess.

20. The container as defined by claim 19 further comprising a support abutting said cam and affixed along the longitudinal axis of said container.

21. The container as defined by claim 19 wherein said at least one recess comprises a plurality of recesses, whereby rotation of said trays is synchronous.

22. The container as defined by claim 1 wherein:

(a) said at least one terminal section comprises, situated at opposite ends of said container:

(i) a first terminal section comprising a receptacle, or an attachment for holding an implement, affixed in said at least one recess; and (ii) a second terminal section comprising a tray mounted to rotate into and out of each said at least one recess;

(b) said at least one ferrule comprises two ferrules, one associated with each terminal section; and (c) said at least one surface comprises two surfaces, one situated at the end of each terminal section.

23. The container as defined in claim 22 further comprising a central section adapted to receive said ferrules one at a time, for successive exposure of said at least one recess in said outer walls of said respective terminal sections.

* * * * *

UNITED STATES PATENT AND TRADEMARK OFFICE

CERTIFICATE OF CORRECTION

PATENT NO. : 4,779,753

DATED : October 25, 1988

INVENTOR(S) : Gilbert CAPY

It is certified that error appears in the above-identified patent and that said Letters Patent is hereby corrected as shown below:

On the front page, left column, line 7 of the Foreign Application Priority Data, insert ---.--- after "6" and before "0".

At column 1, line 55, insert ---at--- before "least".

At column 5, line 3, delete "," after "hand".

At column 6, line 3, change "a" to ---at---.

At column 6, line 37, insert ---,--- after "sections".

At column 6, line 59, change "whbich" to ---which---.

Signed and Sealed this

Sixth Day of June, 1989

*Attest:*

*Attesting Officer*

DONALD J. QUIGG

*Commissioner of Patents and Trademarks*